United States Patent [19]

Ronkholz-Tölle, nee Tölle

[11] 3,946,789

[45] Mar. 30, 1976

[54] SLATTED CURTAIN

[76] Inventor: Roswitha Ronkholz-Tölle, nee Tölle, Drakestrasse 4, Dusseldorf, Germany

[22] Filed: Aug. 2, 1974

[21] Appl. No.: 494,335

[30] Foreign Application Priority Data

Aug. 6, 1973 Germany ..... 2339699

[52] U.S. Cl. ..... 160/166 A; 160/84 R; 160/168 R

[51] Int. Cl.[2] ..... E06B 9/26

[58] Field of Search ..... 160/166 A, 178 R, 168, 160/84 R

[56] References Cited

UNITED STATES PATENTS

| | | | |
|---|---|---|---|
| 3,386,490 | 6/1968 | Kandel | 160/178 R |
| 3,844,330 | 10/1974 | Hyman | 160/166 A |

*Primary Examiner*—Philip C. Kannan

*Attorney, Agent, or Firm*—Joseph A. Geiger

[57] ABSTRACT

A slatted curtain having covering slats and transparent slats arranged so that when the curtain is open each two adjacent covering slats form two sides of an H, while the transparent slat between them forms the crosspiece of the H.

10 Claims, 14 Drawing Figures

1
2
3
4
5

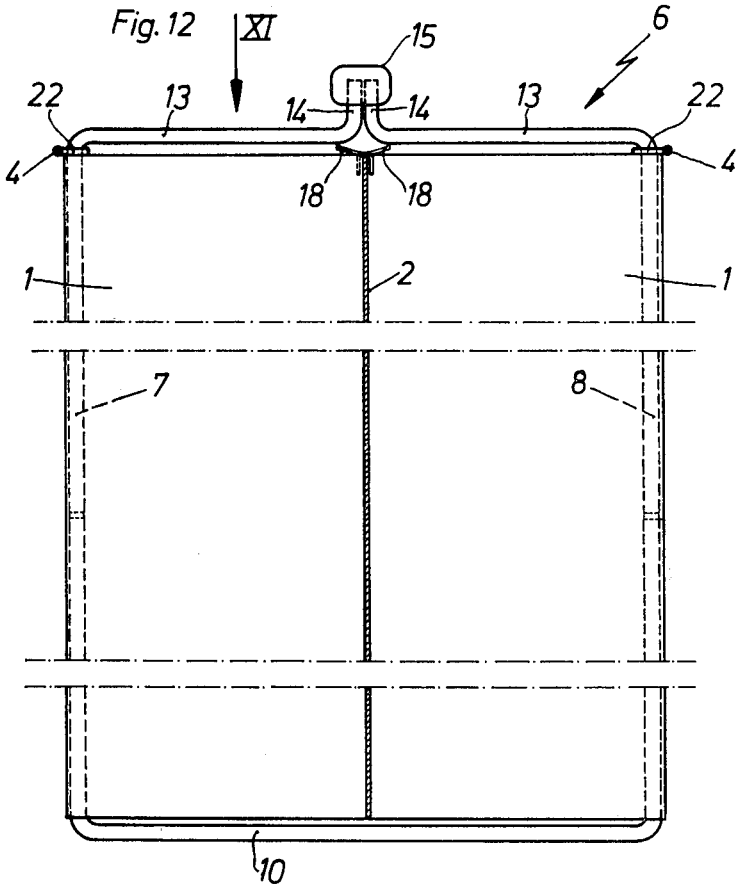
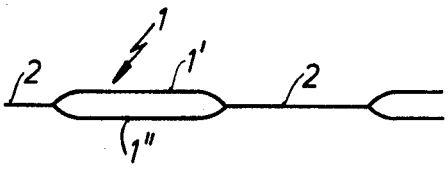
Fig. 13
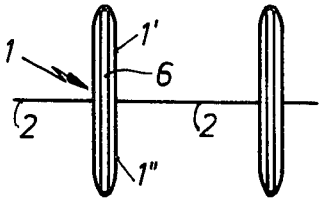
Fig. 13a

SLATTED CURTAIN

BACKGROUND OF THE INVENTION

1. Field of the Invention

This invention relates to a slatted curtain with parallel and angularly adjustable covering slats and with interposed transparent slats followed one another in alternation and flexibly interconnected, the covering slats being far less translucent than the transparent slats and enabling the entering light to be dimmed as a result of their adjustment to a certain angle.

2. Description of the Prior Art

A slatted curtain of this kind is already known from Ger. Regd. Design 7,008,554. By comparison with other known slatted curtains, which have only covering slats, gaps being left between the latter, a slatted curtain of the aforementioned kind offers the advantage that it performs the function of three known types of window covering i.e:

The curtain, which makes it difficult to see into the room by day and which also agreeably filters the daylight.

(Open position: the covering slats are transverse to the window surface).

The outer curtain (decoration), making it difficult to see into the lighted room in the evening.

(Closed position: the covering slats are approximately parallel to the window surface).

The Venetian blind, in the case of strong sunlight, protects the room from heat.

(Half-open and half-closed position: the covering slats are oblique in respect of the window surface, in accordance with the angle of the sunrays themselves).

In the known slatted curtain the covering slats and the transparent slats consist of fabric, that of the former being as non-transparent and that of the latter as transparent as possible. The covering slats are in each case connected by both longitudinal edges to the two adjacent transparent slats, the method adopted in one version being the connection of each longitudinal edge to one transparent slat, on the respective two sides, while another version is based on a zigzag arrangements of the transparent slats between the covering slats, so that the former are connected with the mutually opposite longitudinal edges of two of the latter, adjacent to each other. The first version suffers from the drawback that when the curtain is open two transparent slats are resting one above the other, which not only involves consumption of a greater quantity of material but is also a disadvantage because it is in any case difficult, in a continuous web of fabric, to weave the transparent slats in such a way that they will let appreciably more light through than the covering slats. In the other version the operating efficiency depends on the accuracy of the zigzag folds between the covering slots and the transparent slats. It is true that these folds can be made initially accurate, but they become less so after the curtain has been washed a number of times. Furthermore, the zigzag folding of the slatted curtain only enables it to be closed towards one side and not towards either side desired.

Despite the appreciable basic advantages of the known type of slatted curtain, as described in Ger. Regd. Design 7,008,554, the constructional versions thereof have not proved satisfactory, as too many defects have come to light in its practical operation.

SUMMARY OF THE INVENTION

The object of this invention is to provide a slatted curtain of the type mentioned at the beginning which will meet practical needs more satisfactorily, without sacrificing the aformentioned basic advantages, and which, in particular, will be easier to manufacture, in addition to being less liable to fail when carelessly handled and remaining efficient after a long period of use. It is also capable of fulfilling in an optimum manner, the functions of curtain, outer curtain and Venetian blind as mentioned at the beginning.

This invention provides a slatted curtain of the aforementioned kind in which the covering slats and the transparent slats, when the curtain is in the open position, are so arranged in relation to one another as to present an H-shaped cross section, each two adjacent covering slats forming the two sides of an "H," while the transparent slat between them forms its crosspiece.

This arrangement of the transparent slats in relation to the covering slats offers the advantage that in the open position there is only one single layer of transparent slats, resulting in extra translucency, in addition to which the transparent slats are always situated in one common plane, which is usually parallel to the window surface, so that by comparison with the known zigzag arrangement a saving of material is obtained and operational efficiency greatly improved, as it no longer depends on accurate folds. The curtain can also be opened towards either side desired. Furthermore, the covering slats can be made about twice as wide as the transparent slats, so that in the closed position they completely cover these latter. If the covering slats are given a different colour, e.g. red, on the side facing towards the right-hand transparent slats, for instance, from the colour, e.g. blue, of their other side, facing towards the left, then either a red or a blue visible complete surface can be obtained in the closed position, according to whether the latter is reached by pivoting the covering slats toward the left or towards the right. This enables the decorative scheme of the interior of the room to be varied. On the outside, this effect can be utilized for the choice between an external surface which will reflect light to the maximum and one which will absorb as much heat as possible.

The "H-configuration" in which the covering slats and and the transparent slats are combined according to the invention can also be obtained with slats consisting, for example, of strips of plastic foil having certain degrees of intrinsic rigidity, in which case the articulated connection can be provided by means of so-called foil hinges. A further version of the invention relates to a construction in which, in the foregoing manner, the covering slats and the transparent slats are provided by a cohesive web of fabric consisting of alternating sections of varying transparency. A cohesive web of some other covering material, such as plastic foil, would also be suitable. In this case the covering slats are formed, according to the invention, by double-layered hose-like portions of the web of textile or foil, each section containing a stiffening element. This stiffening element is then turned, inside the hose-like portion, in such a way as to produce the desired H-configuration for the covering slats and transparent slats in conjunction with one another. The entire web of textile or foil can be removed for washing or other cleaning operations. It is no longer necessary to form any particular folds, so that this does not even have to be considered in the washing. Reduced translucency will already be ensured in the covering slats as a result of the double layer of the web of textile or foil on the hose-like portions. The inserted stiffening elements, e.g. in the form of strips of intrinsically rigid strips of plastic foil, may likewise be non-translucent.

It is also perfectly possible to make the hose-like portions of a far denser fabric. In one preferred embodiment the double-layer hose-like portios alternate with single-layer sections, to form continuous fabric, these latter forming the transparent slats. It is true that this method was already adopted in the known slatted curtain mentioned at the beginning, but it was found that the single-layer covering slats provided therein could not be woven densely enough to ensure the desired reduced translucency without at the same time making the transparent slats insufficiently translucent. The reason is that with a continuous fabric all the slats must have common horizontal woof threads, so that it is only by varying the vertical warp threads that the translucency can be varied. If comparatively thick woof threads are adopted, so that in conjunction with their thick warp threads the covering slats will be as non-translucent as possible, then the translucency of the transparent slats likewise will be correspondingly reduced as a result of the thick woof threads. It is true that attempts have been made to remedy this difficulty by leaving the transparent slats entirely without warp threads, but the said slats thereby lose part of their strength and their ability to retain the correct shape. As the covering slats according to the invention are double-layered, a high degree of non-translucency is obtainable even with comparatively thin common woof threads, so that the transparent slats can likewise be woven with warp threads without thereby being rendered excessively non-translucent. It is thus possible for the transparent slats to be woven with fine woof and warp threads, in the form of a fine fabric highly permeable to light, the covering slats being produced with the same fine woof threads and with thicker warp threads, to form a denser fabric having the desired non-translucency as a result of its two layers. The invention thus enables the required webs of textile material and thus the slatted curtains in their entirety to be produced in large quantities on rational lines, to which must be added the great reduction in cost and improvement in operational efficiency as a result of the elimination of certain folds. Thanks to these two improvements in conjunction, the invention represents a break-through to the manufacture of a textile-based Venetian-blind-type shutter as a mass product satisfying all requirements arising in practice.

The stiffening element to which the invention relates, within the hose-like portions belonging to the web of textile or foil and forming the covering slats, provides the conditions for further very advantageous constructional versions of the slatted curtain. For in the first place the stiffening element can be designed as a stretching element acting transversally to the longitudinal direction of the slats, so that the web of textile or foil is always free of folds in that position and does not have to be ironed after washing, while in the second plate suspension devices for the covering slats can be provided on the said stiffening elements, so that the web of textile or foil is not strained by the suspension and operation of the slats. In the case of vertical slats the stiffening element is provided, at its upper end, with a suspension device to support the entire slat, while in the case of horizontal slats this device may be provided at both ends, in order to guide the slat.

BRIEF DESCRIPTION OF THE DRAWING

FIG. 12 shows a section along the line XII—XII of FIG. 11, showing one single covering slat;

FIG. 13 shows a schematic cross-sectional diagram of part of a cohesive web of fabric for the slats; and FIG. 13*a* shows the web of fabric after the introduction of a stiffening element in each case and the way in which it is arranged to form an H-shaped combination of covering slats and transparent slats.

DESCRIPTION OF THE PREFERRED EMBODIMENTS

Figure 1:
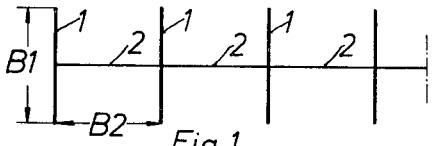
FIGS. 1 through 5 show schematic plan views of a slatted curtain in accordance with the invention, in an open, half-open, another half-open, closed and "collapsed" position respectively.
Figure 2:
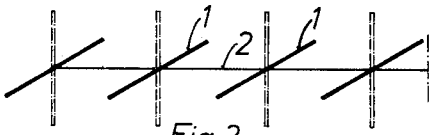
Figure 3:
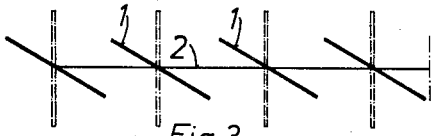
Figure 4:
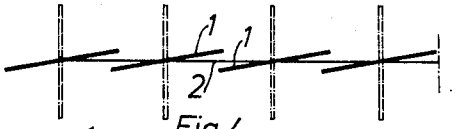

The slatted curtain shown in FIGS. 1 – 6 consists of parallel angularly adjustable covering slats 1 and interposed transparent slats 2 which, when the curtain is in the open position, as shown in FIG. 1, are so arranged in relation to one another as to form a combination of H-shaped cross section, in which each two covering slats 1 next to each other form the branches of an "H," while the transparent slat 2 situated between them forms the crosspiece thereof. The covering slats 1 have a width B1 which in each case is greater than the width B2 of the transparent slats 2, this width B2 being the distance between the two covering slats 1, i.e., the transparent slats 2 are situated in one and the same plane, parallel to the row of covering slats, so that they are usually parallel to the window surface. The covering slats 1 are made as non-translucent as possible, while the covering slats 2 are as permeable as possible to light. In the open position of the curtain, shown in FIG. 1, the transparent slats 2 are completely visible. They form a smooth flat complete surface. For closing the curtain the covering slats may be moved either to the right (FIG. 2) or to the left (FIG. 3) from the open position shown in dot-and-dash lines in FIGS. 2 – 4, so that they will then occupy a position in which the curtain is half open or half closed respectively. The almost closed position is shown in FIG. 4. In this version of the invention, shown in FIG. 1 – 6, the width B1 is only somewhat greater than the width B2, so that in the closed position the width B2 of the transparent slats is covered half by one and half by the other adjacent covering slat, one half being situated in front of and the other half behind the transparent slat 2 concerned, with a certain overlapping in the middle. In the closed state, just half of each transparent slat is then visible on each side of the curtain. With the slats in the position shown in FIG. 1, the entire curtain can be "collapsed" in the known manner (FIG. 5) to form a "stack" of slats. In this position the transparent slats 2 are completely concealed by the covering slats.

Figure 7:
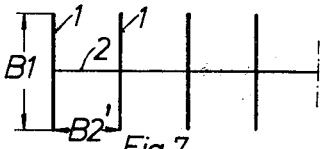
FIGS. 7 & 8 show another version, shown on the same lines as FIGS. 1 and 2, in an open and almost closed position respectively.
Figure 8:
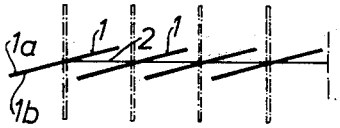
Figure 5:
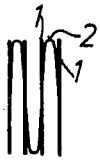
Figure 6:
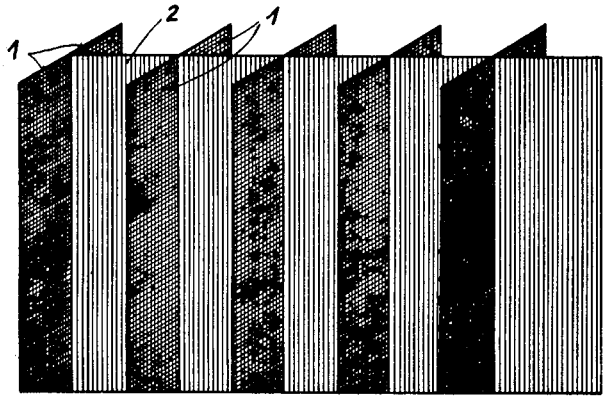
FIG. 6 shows an oblique diagram of the slatted curtain of FIGS. 1 through 5, in the open position.

In the version shown in FIGS. 7 and 8 the covering slats 1 are at a smaller distance apart, so that their width B1 is double the width B2 of the transparent slats. The result is that in the closed state, as shown in FIG. 8, the transparent slats 2 are completely or almost completely concealed by the covering slats 1. If the covering slats 1 have a different colour on one side 1*a* from that of the other side 1*b*, then the closed curtain will always show either the side 1*b* alone or the side 1*a* alone, according to whether the covering slats have been pivoted towards the right or towards the left. This enables attractive decorative effects to be obtained. In the direction of the window surface this effect can be utilized to ensure that a highly light-reflective and heat-reflective layer or slightly reflective or non-reflective layer, as the case may be, faces outwards.

Figures 9, 10:
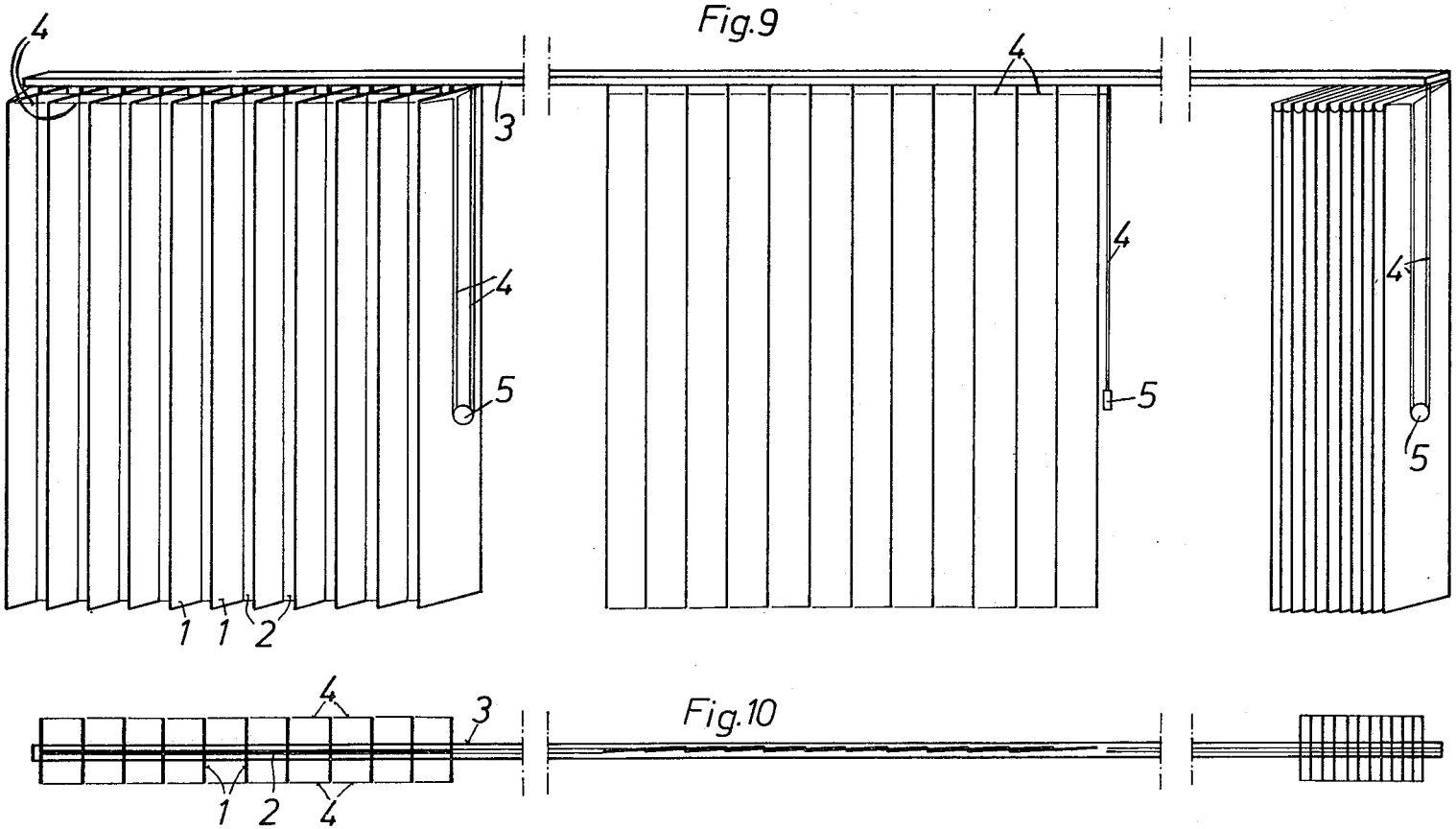
FIGS. 9 & 10 show an oblique diagram and a view from below, respectively, of an entire slatted shutter, with rail, in the open, closed and "collapsed" position respectively.

FIGS. 9 and 10 show the slatted curtain suspended in a curtain bar 3, the diagram on the left, in the middle and on the right showing the curtain in the open, closed and "collapsed" position respectively. On each side of the curtain a slat adjusting cord 4 acts on the upper outer corners of the covering slats 1, this cord being of the "endless" type and descending by the side of the curtain to the usual convenient level for handling. A cord tension pulley 5 is loosely inserted in the reversal end of the endless cord and keeps the latter taut by its weight.

Figure 11:
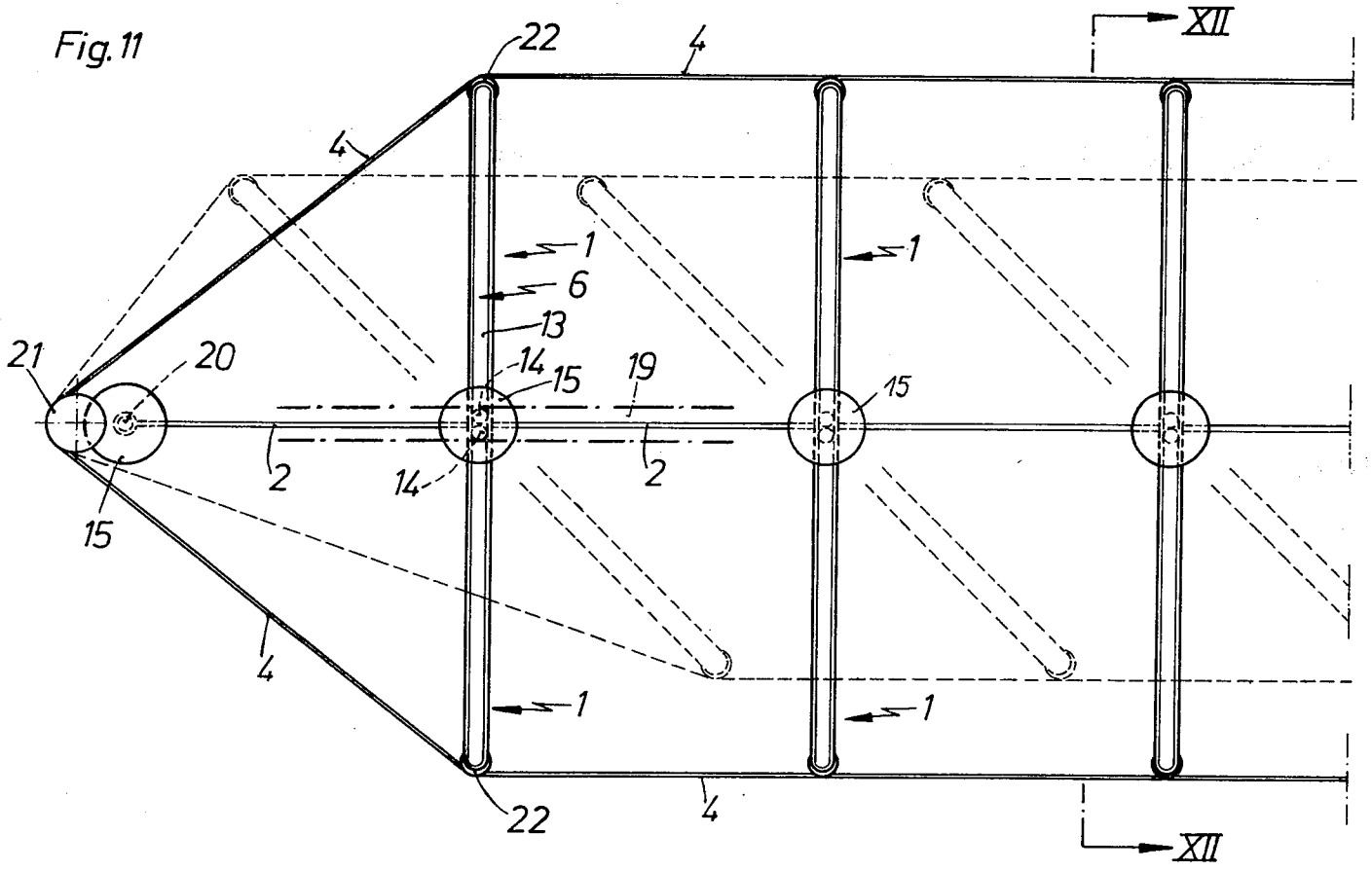
FIG. 11 shows an embodiment of the invention on an enlarged scale (1:1), providing a plan view of the slat arrangement (in the direction shown by the arrow XI of FIG. 12)

While FIGS. 1 through 10 provide schematic diagrams showing the principle of the slatted curtain, FIGS. 11 through 13 illustrate constructional details of one particular embodiment. In this case the covering slats 1 and transparent slats 2 consist of portions, of different transparency, of a cohesive web of textile, the covering slats 1 being formed by double-layer hose-like portions 1′ and 1″ of the web of textile, each such portion containing a stiffening element 6. This principle is shown in FIGS. 13 and 13a. In this preferred embodiment the double-layer hose-like portions 1′ and 1″ alternate with single-layer sections forming the transparent slats 2, thus providing a continuous fabric, in the position shown in FIG. 13. The stiffening element 6 is then inserted in each of the hose-like portions 1′ and 1″ and moved into a position, shown in FIG. 13*a*, in which it will stand perpendicularly to the single-layer portions forming the transparent slats, the desired H-shaped configuration thus being produced.

The stiffening element 6 may consist, as shown in FIG. 13*a*, of an intrinsically rigid strip of plastic foil, the thickness of the strip of plastic foil 6 and the distance between the strip 6 and the portions 1′ and 1″ of the covering slat 1 having been exaggerated in the drawing, for the sake of greater clarity.

In the example shown in FIGS. 11 and 12 the stiffening element 6 consists of a wire frame with two branches 7 and 8 mounted in the longitudinal direction of the slats and having the effect of stretching the textile covering transversally to the said longitudinal direction. The lower end of the wire frame is formed by a U-shaped bracket 10 which can be mounted with a clamping effect on the two branches 7 and 8 of the frame.

At the upper end the two branches 7 and 8 of the wire frame are bent to form horizontal portions 13. The ends of these two portions 13 are brought together and then once again bent upwards to form a portion 14. These portions 14 are then inserted in a "sliding head" 15 which can move to and fro in a curtain rail of the "internal runner" type. The portions 14 thus form a "neck" which extends through the runner slit of the curtain rail. In order to facilitate this movement the two portions 14 can be positioned side by side, as viewed in the direction of the slit. The "sliding head" 15 and the portions 14 of the wire frame which form the "neck" provide the suspension device for the entire slat. Clamps 18 are inserted in the portions 13 of the wire frame, in the vicinity of the portions 14, and serve to secure the respective transparent slats 2 on both sides.

The sliding head 15 is circular in plan view and capable of rotating in the rail when the covering slat 1 is adjusted to the oblique position.

FIG. 11 is a plan view of part of the entire slatted curtain in the open position, while the broken lines show the half open position. The individual stiffening elements 6, with their textile covering which forms the covering slats 1, are suspended via their sliding heads 15 in an "internal runner" curtain rail not shown in FIG. 11, the portions 14 extending through the "runner slit" 19 shown in dot-and-dash lines. On the left-hand end the last transparent slat 2 is held by a round bar 20, likewise suspended by a sliding head 15. In addition, a pulley 21 is provided for the slat adjusting cord 4, which is of the "endless" type and attached at the top to both sides of the wire frame. For this purpose the slat adjusting cord 4 is provided with loops 22, at a certain distance apart, by which it can be suspended over the portions 14 and 13 of the wire frame and rests on the upper edge of the textile covering of the covering slats 1. On the removal of the textile covering, for cleaning purposes, the slat adjusting cord 4 can be left in place.

The examples described relate to a vertical slatted curtain. The same constructional principle, however, can be adopted for the production of a horizontal slatted curtain. In this case the stiffening elements 6 may be provided at both ends with a suspension device running in a rail or along some other guiding device (e.g. on a span wire).

I claim:

1. A decorative window curtain assembly featuring angularly adjustable louver slats of drapable material for the achievement of a variety of different decorative and translucency effects, the curtain assembly comprising in combination:

a series of parallel regularly spaced slats of substantially opaque quality arranged to serve as louvers;

means for rotatably mounting said opaque slats ao as to admit light therebetween when they are oriented perpendicularly to the general plane of the curtain assembly and to progressively shut out the light, as they are re-oriented at a decreasing angle to said plane; and a series of linking slats of substantially translucent quality occupying the spaces between said opaque slats, without substantially affecting the light-controlling action of the latter; the translucent slats being longitudinally connected to the opaque slats, so as to form a continuous assembly of alternatingly opaque and translucent slats in the direction transverse to the extent of the slats; and wherein said continuous assembly of alternatingly opaque and translucent slats is constituted by a continuous web of said drapable material extending in said transverse direction, whereby single-layer web sections alternate with double-layer, tubular web sections of at least equal web length, the former serving as said translucent linking slats, while the latter, transversely flattened so as to leave a minimum interval in the web direction between successive single-layer sections, serve as said opaque slats; and the opaque slats further include slat shaping means holding their constituent double-layer web sections in the aforementioned transversely flattened shape and giving them the character and appearance of louver slats, by stiffening at least their edge portions, thereby creating an H-shaped cross-sectional curtain configuration, two adjacent opaque slats forming the two legs of the H-shape, and the intermediate linking translucent slat forming its cross bar.

2. A curtain assembly as defined in claim 1, wherein the slat shaping means includes a flat rectangular frame inserted between the two web layers of each opaque slat.

3. A curtain assembly as defined in claim 2, wherein said frame is a rectangular wire frame.

4. A curtain assembly as defined in claim 1, wherein the slat shaping means is a stiffening component which is permanently united with the two web layers of each opaque slat.

5. A curtain assembly as defined in claim 1, wherein the slat shaping means is a thin strip or batten of plastic material inserted between the two web layers of each opaque slat.

6. A curtain assembly as defined in claim 1, wherein the slats extend vertically; and said means for rotatably mounting the opaque slats includes: a stationary curtain rail extending above the curtain and having a downwardly facing longitudinal slot, and a sliding head at the upper extremity of each opaque slat riding in said curtain rail in a vertically guided, rotatable engagement therewith.

7. A curtain assembly as defined in claim 1, wherein said drapable material is a woven fabric.

8. A curtain assembly as defined in claim 7, wherein said continuous web with its alternating single-layer and double-layer web sections is woven without seams between successive web sections.

9. A curtain assembly as defined in claim 1, wherein the opaque slats are approximately twice as wide as the translucent slats.

10. A curtain assembly as defined in claim 9, wherein the opaque slats have different surface characteristics on their opposite sides.

* * * * *